United States Patent [19]

Wynn

[11] 3,938,796

[45] Feb. 17, 1976

[54] WORKPIECE LOCATION APPARATUS

[76] Inventor: Gordon Williams Wynn, The Glebe, Holton-cum-Beckering, Lincoln, Lincolnshire, England

[22] Filed: July 1, 1974

[21] Appl. No.: 484,756

[52] U.S. Cl. ..... 269/2; 269/87.2

[51] Int. Cl.[2] ..... B25B 11/00

[58] Field of Search ..... 83/761, 762, 763, 764, 83/765, 766, 767; 269/1.2, 87.1, 87.2, 87.3, 87

[56] References Cited

UNITED STATES PATENTS

| | | | |
|---|---|---|---|
| 415,637 | 11/1889 | Haveisen | 269/87 |
| 565,652 | 8/1896 | Walter | 269/87.2 |
| 638,049 | 11/1899 | Fox | 83/767 |
| 1,193,149 | 8/1916 | Huls | 83/767 |
| 1,520,615 | 12/1924 | Thompson | 83/767 |
| 3,389,724 | 6/1968 | Paul | 269/1 |

*Primary Examiner*—Roy Lake
*Assistant Examiner*—Mark S. Bicks

[57] ABSTRACT

A sawing location apparatus adapted to be placed on a workpiece has a bearing engagement for the workpiece to one side of a saw guide device and a location device on the other side of the saw guide device for setting the workpiece to a desired position in a direction transverse to the cutting plane defined by the saw guide device. Arrangements are described for making right-angled and oblique transverse cuts in an elongate workpiece as well as longitudinally directed cuts in an end face of such a workpiece.

21 Claims, 10 Drawing Figures

WORKPIECE LOCATION APPARATUS

BACKGROUND OF THE INVENTION

This invention relates to apparatus for the location of a workpiece to allow a saw cut to be made in the workpiece at a required position.

Such apparatus is known in which the workpiece is placed on the apparatus for cutting, for example mitre boxes have been produced in the form of a channel in which the workpiece is held and guide slots in the sides of the channel provide for oblique and sometimes right-angled transverse saw cuts to be made in the workpiece. This known apparatus is, however, relatively cumbersome and is limited in the size of workpiece it can accept. A more compact form of guide apparatus has been proposed that is placed upon the workpiece but this is extremely limited in the tasks that can be performed with it. Reference may be had to applicant's U.S. Pat. No. 3,861,665 which discloses a sawing jig which is capable of use in connection with the accurate placing of saw cuts in the end face of an elongate workpiece substantially in the direction of the longitudinal axis of such workpiece. The present invention provides improved apparatus whereby the saw cuts are made across the upper face of the workpiece.

It is an object of the present invention to provide an improved form of saw guide apparatus of the kind that can be placed on a workpiece.

SUMMARY OF THE INVENTION

According to the invention, there is provided location apparatus for use in making a saw cut in an elongate workpiece comprising bearer means adapted to be placed on the workpiece to engage a side face thereof, said means carrying saw guide means defining a saw cutting guide plane perpendicular to said side face, and workpiece location means mounted on the bearer means to define a location for the workpiece in a direction transverse to said guide plane, the position of said location means relative to the guide plane being adjustable in said transverse direction.

Advantageously said bearer means are arranged to engage said side face to one side of the saw guide plane and said workpiece location means are mounted on the bearer means to project to the opposite side of the saw guide plane and define said workpiece location at said opposite side.

The use of apparatus according to the invention may be extended by providing means to locate the workpiece at a predetermined oblique orientation relative to the plane of a face of the bearer means engaging said workpiece side face whereby the workpiece is offset obliquely to said guide plane. Other oblique saw cuts may be made with the employment of supplementary means to locate the workpiece with its longitudinal axis oblique to the saw guide plane while said axis is parallel to the plane of a face of the bearer means engaging said workpiece side face.

Further uses of the apparatus are possible moreover if there is provided an element having a contact face locatable parallel to said saw guide plane is displaceable towards and away from said plane and forms an abutment for location of an elongate workpiece with the workpiece axis parallel to said plane.

BRIEF DESCRIPTION OF THE DRAWINGS

Embodiments of the invention are illustrated by way of example in the accompanying drawings, wherein.

Figure 1:
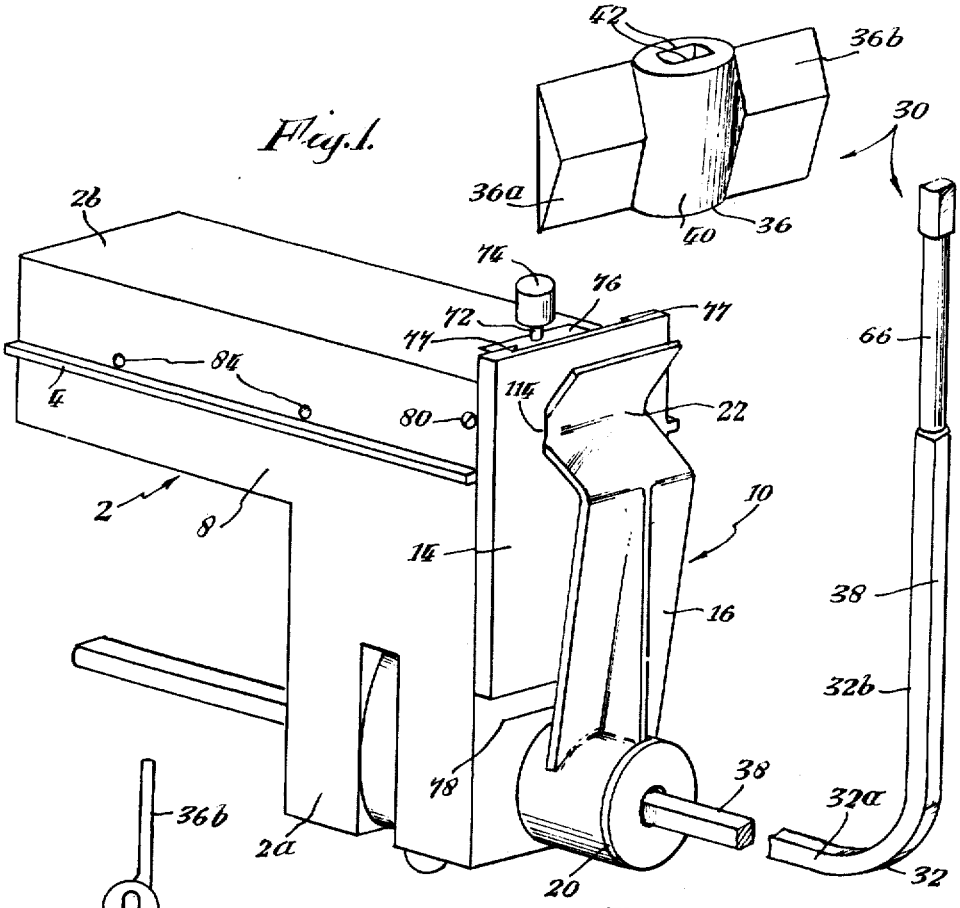
FIG. 1 shows one form of apparatus according to the invention.
Figure 2:
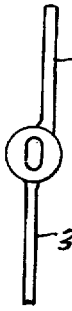
FIG. 2 is a plan view of the selector head in the apparatus of FIG. 1.
Figure 5:
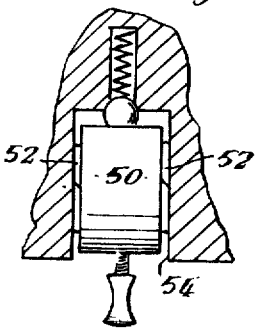
Figure 6:
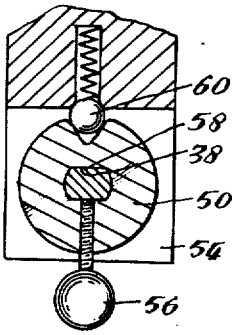

The apparatus shown in FIG. 1 of the drawings comprises a right-angled bearer member 2 carrying a saw guide plate 14 on its forward, dependent limb 2*a* and having a rib 4, which may be detachable, projecting from the face of its longitudinal limb 2*b*. The apparatus is used - is placing it on an elongate workpiece, which for simplicity is not illustrated, with planar side face 8 of the bearer member below the rib 4 against a side face of the workpiece, normally in such a way that the forward limb 2*a*-is disposed vertically. With a uniform cross-section workpiece this setting can conveniently be obtained by using the bottom edge of the rib 4 as an abutment for the top face of the workpiece transverse to said side face. Having thus placed the apparatus on the workpiece a saw cut can be made in the workpiece perpendicular to its axis using saw guide 10, gripping the workpiece and the apparatus firmly together with one hand while the cut is made using a handsaw held in the other hand.

Figure 4:
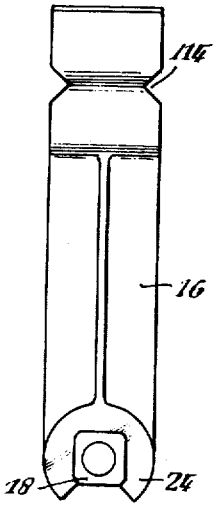
FIGS. 3 and 4 are side and partly sectional end views respectively of the saw guide spring plate in the apparatus of FIG. 1, FIGS. 5 and 6 are detail side and end sectional views respectively of the fixing of the gauge bar in the apparatus of FIG. 1.
Figure 3:
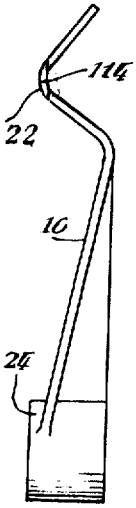

The saw guide comprises a wear-resistant plastics plate 14 which forms a contact face for one side of the saw blade and thus defines the saw guide plane. The saw blade is urged against the plate by a spring blade 16, e.g. of nylon, mounted on a fixed pintle 18 that may be integral with the bearer member. The spring blade is retained on the pintle by a collar 20 that ensures that nose 22 of the spring blade is held against the plate 14 so that the saw blade is engaged by the spring blade. Over the main part of its height, however, there is a gap between the plate 14 and the spring blade to avoid unnecessary wear from rubbing of the saw teeth. The blade is integrally formed with a downwardly open yoke 24 that engages the pintle, the cross-section of which, as FIG. 4 shows, is a modified square form with rounded corners. The engaging surface of the yoke 24 has similar flat portions and the yoke is sufficiently resilient to allow the spring blade to be pivoted on the pintle, to rest for example horizontally away from the plate 14. The top portion of the yoke is of increased thickness as in use it may be expected the saw will sometimes inadvertently be allowed to cut into it. Chamfers 114 can be provided to facilitate insertion of the saw blade between the plate 14 and the nose 22 of the spring.

For positioning a workpiece in the direction transverse to the saw guide plane and so to determine the point along the length of the workpiece at which a saw cut is made, a location device 30 is provided. This comprises an angled gauge bar 32 having horizontal and vertical arms 32*a*, 32*b*, the horizontal arm 32*a* being rotatably and slidably received in an aperture in the limb 2*a* of the bearer member co-axial with and extending through the pintle 18. The vertical limb 32*b* lies in front of and projects above the saw guide.

The gauge bar is fixed in place by a collar 50 gripped by spring washers 52 that are compressed between opposed faces of a slot 54 in the bearer member. The limb 32*a* of the bar passes through the collar and is releasably secured to it by a thumbscrew 56, which thus sets the gauge bar position transversely of the saw guide plane since the collar is itself fixed in this direction. The gauge bar is also rotationally fixed to the collar 50, the aperture in the collar receiving the bar having flats 58 engaging the flat portions 38 that extend along the bar, and the collar and bar are jointly restrained from pivoting by the frictional force of the washers 52 and by a ball detent 60 in the top of the slot 54 that serves to locate the gauge bar with its limb vertical.

Slidably mounted on the limb 32*b* is a reversible selector head 36 of the location device that is used in locating a workpiece longitudinally relative to the saw guide plane formed by the plate 14. The selector head 36 has alternative blades 36*a*, 36*b* these each being of double wedge form and each having a perpendicular gauging face. Diametrically opposite flat portions 38 along the length of the gauge bar engage complementary flat portions 42 on boss 40 of the selector head to locate said perpendicular faces of the blades parallel to the saw guide plane.

The use of the location device as thus far described will be explained by reference to the cutting of an open-ended recess or step at the end of an elongate workpiece, e.g. for a halving joint in a timber frame, using the further elongate timber member that is to form the other half of the joint to gauge the saw cut to be made.

After the spring blade 16 has been swung to the horizontal position, as described above, said further member is placed transversely between the plate 14 and the vertical arm 32*b* of the gauge bar. The gauge bar is then moved towards the plate 14 to grip the width of said further member lightly between the plate and the opposed rear flat 38 of the arm 32*b* and the gauge bar is clamped by the thumbscrew 56. In this state, and with the blade 36*a* of the selector head projecting, as illustrated in FIG. 1, out of the plane of the side face 8, the rearwardly directed perpendicular face of the blade 36*a* is coplanar with said opposed rear flat 38. Said face is then in a position to locate an end face of the workpiece for the inner end of the open-ended recess to be cut. With the further member removed, the apparatus can now be placed on the workpiece with a side face of the workpiece against the bearer member side face 8 and the end of the workpiece aligned with the bottom edge of the blade 36*a* and a saw cut made to the required depth by a saw located in the saw guide, this producing the inner end of the required open-ended recess having a length equal to the width of said further member.

When cutting a recess for a halving joint recess intermediate the length of a workpiece, after a saw cut has been made for the first end of the recess, the location device 30 is used in a similar manner to locate the workpiece for the second cut. The further member of the joint is used in precisely the same manner as previously to set the gauge bar position but now the alternative blade 36*b* of the selector head locates the workpiece.

To do this, the selector head is rotated on the gauge bar to bring the blade 36*b* to the position in which it porjects out of the plane of the bearer member side face 8 and over the workpiece. For this purpose, the arm 32*b* of the gauge bar has a necked portion 66 of a sufficiently small diameter to allow the selector head to be swung round when its boss 40 is raised to that portion. The perpendicular face of the blade 36*b* is now co-planar with the rear opposed flat 38 referred to above and the blade can be slid downwards into the first saw cut in the workpiece so that said face of the blade engages that face of said saw cut that will form an end face of the recess. A second saw cut made using the saw guide will then form the opposite end of the recess.

The different position obtained by use of the alternative blade 36*b* as compared with the use of the blade 36*a* for an open-ended recess compensates for the thickness of the saw kerfs within the length of the required recess, there being two saw kerfs in the intermediate jointing recess as compared with the single saw kerf in an end recess.

Where it is desired to make a number of recesses of corresponding lengths, it may only be necessary to gauge the width of the first recess and to not engage the selector head blade with the first end saw cut of subsequent recesses. This can be done by again pivoting the spring blade No. 16 downwards so that relative longitudinal movement is possible between the apparatus and the workpiece while a saw is lodged in the first saw cut in the workpiece to bring the saw blade from said plate 14 to said gauge bar in order thereby to obtain a repositioning of the apparatus on the workpiece to an extent predetermined by the spacing of said gauge bar from the saw guide plane.

Single or a series of identical open ended recesses can similarly be formed without the use of the selector head 36, by rotating upper arm 32*b* against the action of ball detent 60, so that the arm provides an abutment for the end of the workpiece.

It may be mentioned here that although the perpendicular faces of the blades have been described as being coplanar with said rear opposed flat, this is preferably not exactly so. It is advantageous to arrange that the blade 36*a* causes an open-ended recess to be cut marginally longer than is theoretically correct, so allwoing the end face of the workpiece to be cleaned up, as is often needed with timber sections: also, the blade 36*b* should cause an intermediate recess to be cut marginally shorter than is theroretically correct to give an interference fit with the further jointing member and thus a tight joint. The out-of-plane divergence need only be slight — less than 1 mm — in each instance.

The double wedge formation of each blade 36*a*, 36*b* allows the apparatus to be used as by a left-handed operator by taking the selector head off the gauge bar and replacing it in the reversed position. The bearer member will then project to the right of the saw guide allowing the operator to hold the saw in his left hand.

In the preceding description, it has been assumed that the bearer member locating face 8 will engage the rear side face of the workpiece. Provided both opposite sides of the bearer member have a similar arrangement of locating face 8 and rib 4, it is also possible to use the apparatus with it against the front side face of the workpiece but now the selector head orientation described for a left-handed operator will serve instead for a right-handed operator and vice versa.

The apparatus can further include means for limiting the depth of a saw cut to a predetermined extent. In one form this comprises a screwed member 72, the head 74 of which is sufficiently close to the saw guide plane to be in the way of the spine of a backsaw or dovetail saw as the saw descends. The member 72 is a free fit in an aperture in the bearer member and can be dropped into place. Its height is determined by a nylon nut 76 screwed onto it that rests on the top surface of the bearer member. The member can thus be simply lifted out when not needed and will take up its previous setting automatically when dropped in again.

The drawings also show the saw guide plate 14 to be adjustable in a way that allows it to be used too as a depth stop in the path of the saw spine. It is desirable to have the plate replaceable as it will be subject to wear from the saw teeth and as shown it has opposed lips 77 to slide into place along a dovetail 78 on the bearer member forward limb 2*a*. If the plate is left in a partly raised position and locked there by a grub screw 80, it will similarly limit the descent of a back saw.

Figure 7:
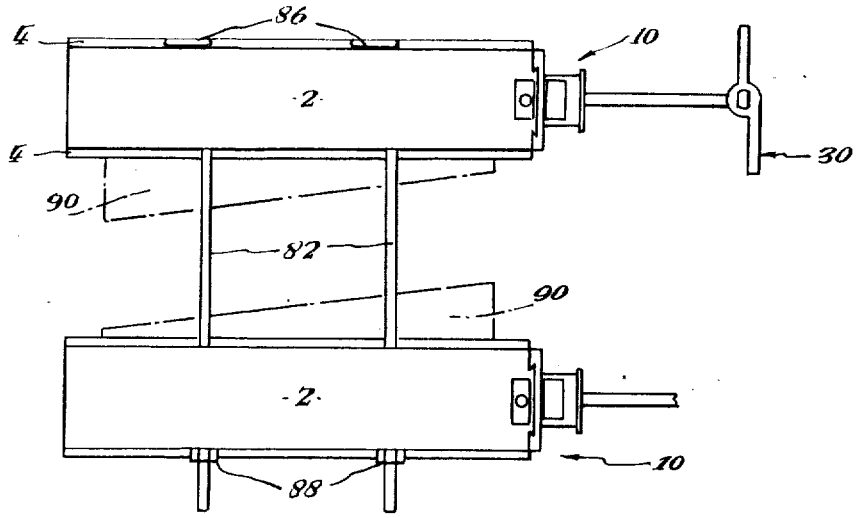
FIG. 7 is a plan view of a modified arrangement of apparatus according to the invention generally similar in its constructional details to the apparatus of the preceding figures.
Figure 10:
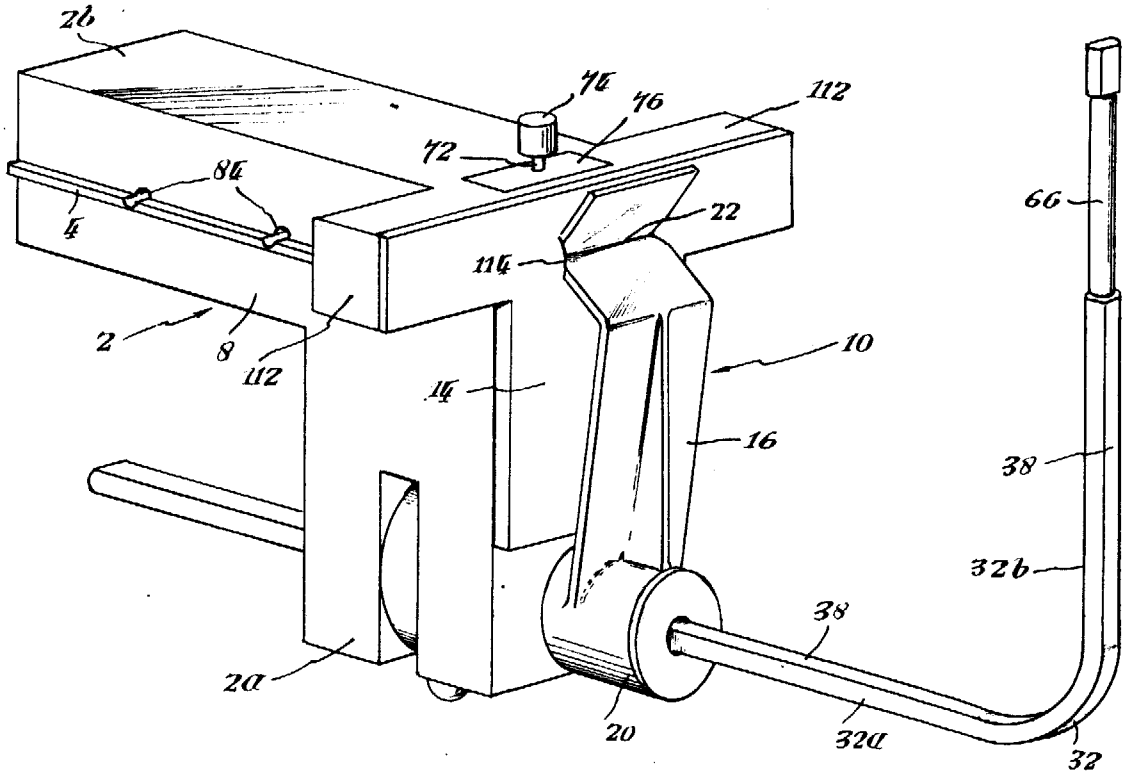
FIG. 10 shows an alternative form of the apparatus according to the invention.

A modified arrangement is shown in FIG. 7 using two bearer members 2, connected together by parallel rods 82 through apertures 84 (FIG. 1) immediately above the ribs 4. Said apertures can conveniently be insert into ribs 4 so that the bottom faces of the ribs and the underside of rods 82 are coplanar, as illustrated in FIG. 10. The members are retained on the rods by bent over ends 86 at one end of the rods and spring clips 88 at the other, the arrangement permitting variation of the spacing between the members 2 to suit a particular workpiece sandwiched between them. Corresponding saw guides 10 on both members 2 locate the saw blade on both sides of the workpiece but it will generally be necessary to employ only one location device 30.

Figure 8:
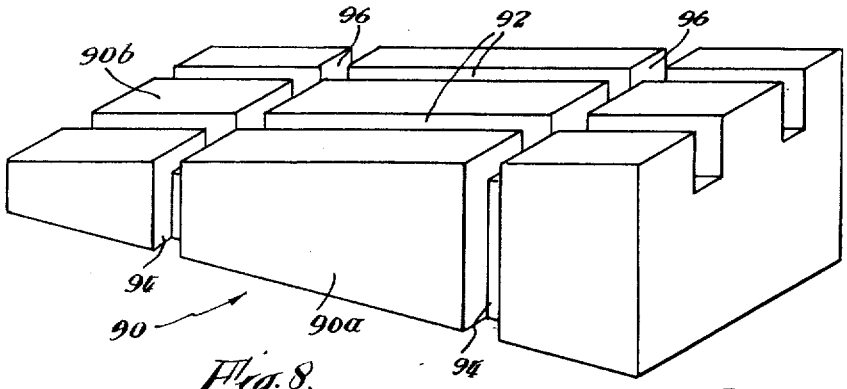
FIG. 8 illustrates one of the wedges shown in FIG. 7.

The double-member arrangement is particularly advantageous when oblique saw cuts are to be made in the workpiece, as for dovetail joints. FIG. 7 shows the use of wedges 90 (FIG. 8) to make such cuts in a horizontally disposed workpiece, oblique to its engaged side faces. Slots 92 in the wedges locate then on the ribs 4 with their major part below the ribs, the further slots 94 in both tapered faces 90*a* receiving the portions of the rods 82 adjacent the slots. The rods provide locating abutments setting the top face of the workpiece horizontal. It will be clear that the wedges can be reversed from the position shown to give an oppositely inclined saw cut in the workpiece, for example the oppositely inclined faces of a dovetail slot being cut by these alternative positions of the wedges.

The wedges 90 can also be used when making a cut oblique to the side faces of the workpiece but at right-angles across its top face. To do this a tapered face 90*a* of the wedge is placed against a bearer member side face 8 and a parallel-sided face 90*b* is placed against the underside of a rib. The slots 96 in this latter face now receive the rods 82, said slots 96 being provided in both parallel-sided faces. A workpiece placed against the side face 8 with the workpiece top face abutting the underside of the wedge thus has its axis inclined to the horizontal at the wedge angle.

Figure 9:
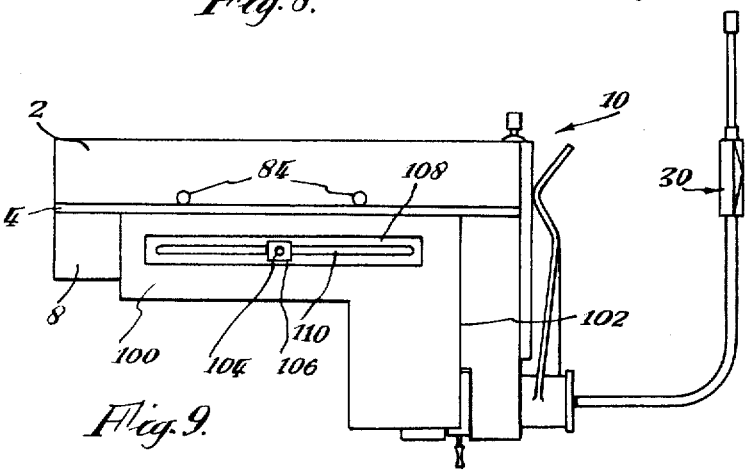
FIG. 9 is a side view of another modified arrangement of apparatus according to the invention.

Another modified arrangement shown in FIG. 9 is capable of being placed on the upper end of an upright elongate workpiece to make saw cuts in its upper end face. An angled locating member 100 has a top edge located by the rib 4 to set front edge 102 parallel to the saw guide plane as a location for a side edge of the workpiece. The locating member is slidable along the rib to determine the spacing of said side edge from the saw guide plane and is secured in place by a locking screw 104 engaging a nut 106 in a recess 108. The screw projects through an aperture in the bearer member, its head being hidden behind that member in the drawing and through a slot 110 in the locating member that thus allows the locating member to be displaced along the bearer member.

Improved lateral saw control is achieved with the apparatus shown in FIG. 10. Shoulders 112 extend from the bearer member 2 above the line of the bottom edges of the ribs 4; the plastics contact plate 14 attached to the front face of the bearer member is consequently T-shaped.

What I claim and desire to secure by Letters Patent is:

1. Workpiece location apparatus for making a saw cut at a predetermined location in an elongate workpiece comprising: a bearer member adapted to be placed on the workpiece in fixed relation to and engageable with a side face thereof; saw guide means including a planar element carried by said bearer member in fixed relation therewith to thereby define a saw cutting guide plane perpendicular to said side face, said saw guide means including biasing means adapted to urge a saw blade against said planar element and presenting a guide opening for introduction of the saw blade from above, said biasing means and planar element thus being adapted to maintain the saw blade in said saw cutting guide plane during the cutting cycle; and workpiece location means mounted on said bearer member adapted to define a location for the workpiece in a direction transverse to said saw cutting guide plane, said location means being adjustably mounted on said bearer member relative to said guide plane in said transverse direction.

2. Apparatus according to claim 1 wherein said bearer member are arranged to engage said side face to one side of the saw guide plane and said workpiece location means are mounted on the bearer member to project to the opposite side of the saw guide plane and define said workpiece location at said opposite side.

3. Apparatus according to claim 2 wherein the saw guide means comprises a surface at said saw guide plane and facing said workpiece location means, the arrangement providing or permitting to be provided an unobstructed space between said guide means surface and an element of said location means whereby relative longitudinal movement is possible between the apparatus and the workpiece while a saw is lodged in a transverse saw cut in the workpiece to bring the saw blade from said guide means surface to said location means element in order thereby to obtain a repositioning of the apparatus on the workpiece to an extent predetermined by the spacing of said location means from the saw guide plane.

4. Apparatus according to claim 1 wherein the bearer member comprise two bearer elements arranged to engage the workpiece between them, co-planar saw guides being carried by the bearer elements to define the guide plane for the saw cut in the engaged workpiece.

5. Apparatus according to claim 4 wherein connecting members extend between and joining the bearer elements are adapted to permit the spacing of the bearer elements to be adjusted.

6. Apparatus according to claim 1 wherein means are provided to locate the workpiece at a predetermined oblique orientation relative to the plane of a face of the bearer member engaging said workpiece side face whereby the workpiece is offset obliquely to said guide plane.

7. Apparatus according to claim 1 wherein supplementary means are provided to locate the workpiece with its longitudinal axis oblique to the saw guide plane while said axis is parallel to the plane of a face of the bearer member engaging said workpiece side face.

8. Apparatus according to claim 1 wherein the bearer member are provided with means to engage a further side face of the workpiece transverse to the first-mentioned side face, and to locate said further side face perpendicular to the saw guide plane.

9. Apparatus according to claim 1 wherein the workpiece location means comprise a limb or column extending parallel to said saw guide plane.

10. Apparatus according to claim 9 wherein a blade is carried by said limb or column for indicating the workpiece position for said location of the workpiece.

11. Apparatus according to claim 10 wherein means are provided for gauging the position of said blade for the making of a transverse saw cut of a jointing recess by measurement directly from the other member of the joint.

12. Apparatus according to claim 10 wherein there is a pair of blades to be used alternatively in association with said location means, in dependence upon whether the recess is to be formed at an end of the workpiece or intermediate its length.

13. Apparatus according to claim 12 wherein an adjustable selector head carried by said column has said blades integral therewith.

14. Apparatus according to claim 13 wherein pivot engagement means are provided for the selector head for rotation of the head about an axis parallel to the saw guide plane to bring alternative ones of said blades to their operative positions.

15. Apparatus according to claim 1 wherein an element having a contact face locatable parallel to said saw guide plane is displaceable towards and away from said plane and forms an abutment for location of an elongate workpiece with the workpiece axis parallel to said plane.

16. Apparatus according to claim 1 wherein the saw guide means includes resilient means adapted to urge a saw blade into contact with said element, said resilient means being displaceable to and from a position opposite the planar element.

17. Apparatus according to claim 1 wherein the saw guide means comprises a rigid planar element defining a guide plane and securable at an adjustable height to the bearer member to act as stop means adapted to limit the depth of a cut made by the saw.

18. Apparatus according to claim 9 wherein workpiece location is effected by rotation of said limb or column, about an axis perpendicular to said saw guide plane, to provide an abutment for an end of an elongate workpiece.

19. Workpiece location apparatus for making a saw cut at a predetermined location in an elongate workpiece, comprising a bearer member adapted to be placed on the workpiece to engage a side face thereof, saw guide means carried by said bearer member to define a saw cutting guide plane perpendicular to said side face, and workpiece location means mounted on said bearer member adapted to define a location for the workpiece in a direction transverse to said saw guide plane, said location means being adjustably mounted on said bearer member, said location means including a limb extending parallel to said saw guide plane and said location means being mounted on said bearer member by mounting means adapted to permit adjustment of said limb in said transverse direction, said location means further including a pair of gauging blades arranged on said limb for use selectively in dependence upon the location of the saw cut to be made along the length of the workpiece.

20. Workpiece location apparatus for making a saw cut at a predetermined location in an elongate workpiece comprising a bearer member adapted to be placed on the workpiece to engage and provide a planar location for a side face thereof, saw guide means carried by said bearer member defining a saw cutting guide plane perpendicular to said side face, and workpiece location means carried by said bearer member defining a location for the workpiece in a direction transverse to said guide plane, said location means being carried by said bearer member in a manner permitting adjustment of the position of said location means relative to the guide guide plane in said transverse direction, said location means including a limb extending parallel to said saw guide plane and rotatable about an axis perpendicular to said saw guide plane to project selectively to either side of said workpiece side face location plane whereby in one of said selected positions of projection it provides an abutment for an end face of the workpiece.

21. Workpiece location apparatus for making a saw cut at a predetermined location in an elongate workpiece comprising a bearer member adapted to be placed on and be supported by the workpiece, said bearer member comprising respective elements for location against a side and a top face of the workpiece, saw guide means carried by said bearer member to provide a saw guide face extending below said bearer member top face location element and defining a saw cutting guide plane perpendicular to said side face, and workpiece location means mounted on the bearer member to define a location for the workpiece in a direction transverse to said guide plane, the position of said workpiece location means relative to the guide plane being adjustable in said transverse direction, said workpiece location means including an attaching element disposed below the saw guide face and extending from the bearer member transversely to the saw guide plane, and an elongate element extending upwardly from said attaching element parallel to the saw guide plane and at least substantially to the level of said top face location element, said bearer member and said elongate element being disposed on opposite sides of the saw guide plane whereby said workpiece transverse direction location means register with a portion of the workpiece projecting beyond the bearer member.

* * * * *